US010456654B1

(12) United States Patent
Kuo

(10) Patent No.: US 10,456,654 B1
(45) Date of Patent: Oct. 29, 2019

(54) MULTIFUNCTIONAL BASEBALL PITCHING APPARATUS

(71) Applicant: Chou-Chien Kuo, Dongguan (CN)

(72) Inventor: Chou-Chien Kuo, Dongguan (CN)

( * ) Notice: Subject to any disclaimer, the term of this patent is extended or adjusted under 35 U.S.C. 154(b) by 0 days.

(21) Appl. No.: 16/293,675

(22) Filed: Mar. 6, 2019

(30) Foreign Application Priority Data

May 24, 2018 (CN) ..... 2018 2 0782695 U

(51) Int. Cl.
*A63B 69/40* (2006.01)
*A63B 69/00* (2006.01)

(52) U.S. Cl.
CPC ..... *A63B 69/408* (2013.01); *A63B 69/0002* (2013.01); *A63B 2069/0006* (2013.01)

(58) Field of Classification Search
CPC ..... A63B 69/40; A63B 69/00; A63B 69/36; F41B 3/04; F41B 4/00; A01K 15/02
See application file for complete search history.

(56) References Cited

U.S. PATENT DOCUMENTS 5,417,196 A * 5/1995 Morrison ..... A63B 69/40 124/6
5,590,876 A * 1/1997 Sejnowski ..... A63B 69/407 473/417
6,672,297 B1 * 1/2004 Liao ..... A63B 69/0002 124/6
7,207,893 B1 * 4/2007 Louie ..... A63B 63/00 473/166
7,278,934 B2 * 10/2007 McBride ..... A63B 63/00 124/78
7,350,515 B2 * 4/2008 Yao ..... A63B 47/002 124/49
9,022,016 B1 * 5/2015 Hafer ..... F41B 4/00 124/6
9,320,960 B1 * 4/2016 Ward ..... A63B 69/407
9,579,554 B1 * 2/2017 Madden ..... A63B 69/408
2002/0107080 A1 * 8/2002 Hsu ..... A63B 67/02 473/191
2006/0135290 A1 * 6/2006 Lin ..... A63B 69/0002 473/451
2009/0260612 A1 * 10/2009 Grant ..... A63B 69/406 124/78
2012/0196707 A1 * 8/2012 Thoman ..... A63B 69/406 473/436

* cited by examiner

*Primary Examiner* — Eugene L Kim
*Assistant Examiner* — Christopher Glenn
(74) *Attorney, Agent, or Firm* — Leong C. Lei

(57) ABSTRACT

A multifunctional baseball pitching apparatus includes a base, a housing, a ball-feeding wheel, an inner seat, a hitting rod, a driving device, and an adjusting device. The baseball pitching apparatus adopts the adjusting device to adjust the preload force of a hitting rod and is provided with a plurality of adjusting gears so that the user can perform setting according to requirements, thereby realizing different hitting heights and distances and meeting different needs for hitting baseballs. The baseball pitching apparatus is fully automated, which provides great convenience for training.

8 Claims, 4 Drawing Sheets

MULTIFUNCTIONAL BASEBALL PITCHING APPARATUS

BACKGROUND OF THE INVENTION

1. Field of the Invention

The present invention relates to sports equipment, and more particularly to a multifunctional baseball pitching apparatus.

2. Description of the Prior Art

As the standard of living continues to improve, increasingly more people have recognized the importance of having a strong body and are gradually turning to various sports training to strengthen themselves. This has thus led to the expanding market for products related to ball sports. Whether they are professional or amateur, most players will use a ball pitching machine to help improve their efficiency. With a ball pitching machine, there is less need for a training partner to pick balls and one can train solo while effectively increasing competitive skill level and achieving the objective of training. However, traditional ball pitching machines are unable to regulate the force of ball shots, making the shots unvaried and unable to satisfy the need of ball players. Thus, ball pitching machines should be improved to enable variation in the force of each shot, making sports more fun and exciting.

SUMMARY OF THE INVENTION

In view of the shortcomings of the prior art, the primary object of the present invention is to provide a multifunctional baseball pitching apparatus. The baseball pitching apparatus provides an adjusting device for adjusting the preload force of a hitting rod to accomplish different hitting heights and distances, meeting different needs for hitting baseballs. The baseball pitching apparatus provides great convenience for training, and has a simple structure. It is convenient to assemble the baseball pitching apparatus.

In order to achieve the above object, the present invention adopts the following technical solutions:

A multifunctional baseball pitching apparatus comprises a base, a housing, a ball-feeding wheel, an inner seat, a hitting rod, a driving device, and an adjusting device. The housing is fixed to the base. An outer surface of the housing is concavely formed with a ball passage. The housing has a launching opening passing through inner and outer surfaces of the housing. An upper end of the launching opening is in communication with a distal end of the ball passage. The ball-feeding wheel is pivotally connected to the base and exposed at the distal end of the ball passage. The inner seat is fixed to the base and located in the housing. The hitting rod is pivotally connected to and located in the inner seat. A front end of the hitting rod has a hitting portion located in the launching opening. The driving device is disposed on the inner seat. The driving device drives the ball-feeding wheel and the hitting rod to turn. The adjusting device is mounted to the housing and located below the hitting rod. The adjusting device is adjustable and elastically leans against the hitting rod.

Compared with the prior art, the present invention has obvious advantages and beneficial effects. Specifically, it can be known from the above technical solutions:

The invention adopts the adjusting device to adjust the preload force of the hitting rod and is provided with a plurality of adjusting gears, so that the user can perform setting according to the requirements, thereby realizing different hitting heights and distances and meeting different needs for hitting baseballs. The invention is fully automated, which provides great convenience for training. The invention has the advantages of simple structure, convenient assembly, high degree of automation and practical durability.

DETAILED DESCRIPTION OF THE PREFERRED EMBODIMENTS

Embodiments of the present invention will now be described, by way of example only, with reference to the accompanying drawings.

Figure 1:
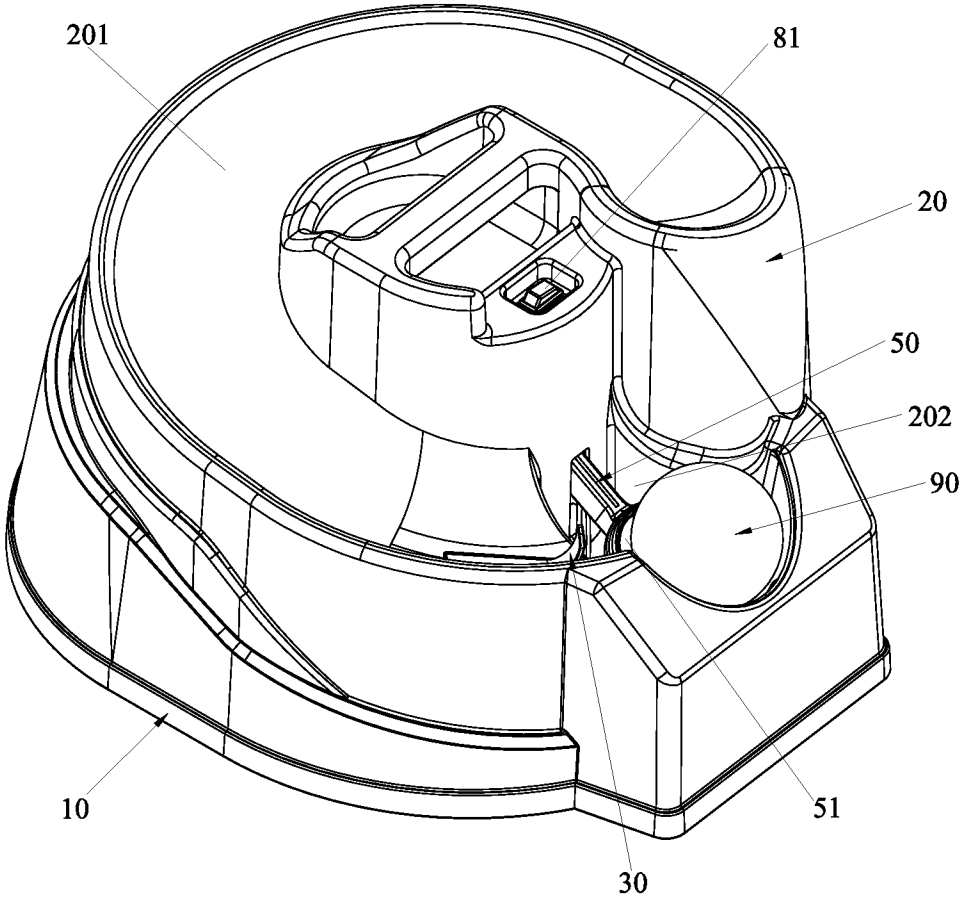
FIG. 1 is a perspective view in accordance with a preferred embodiment of the present invention.
Figure 2:
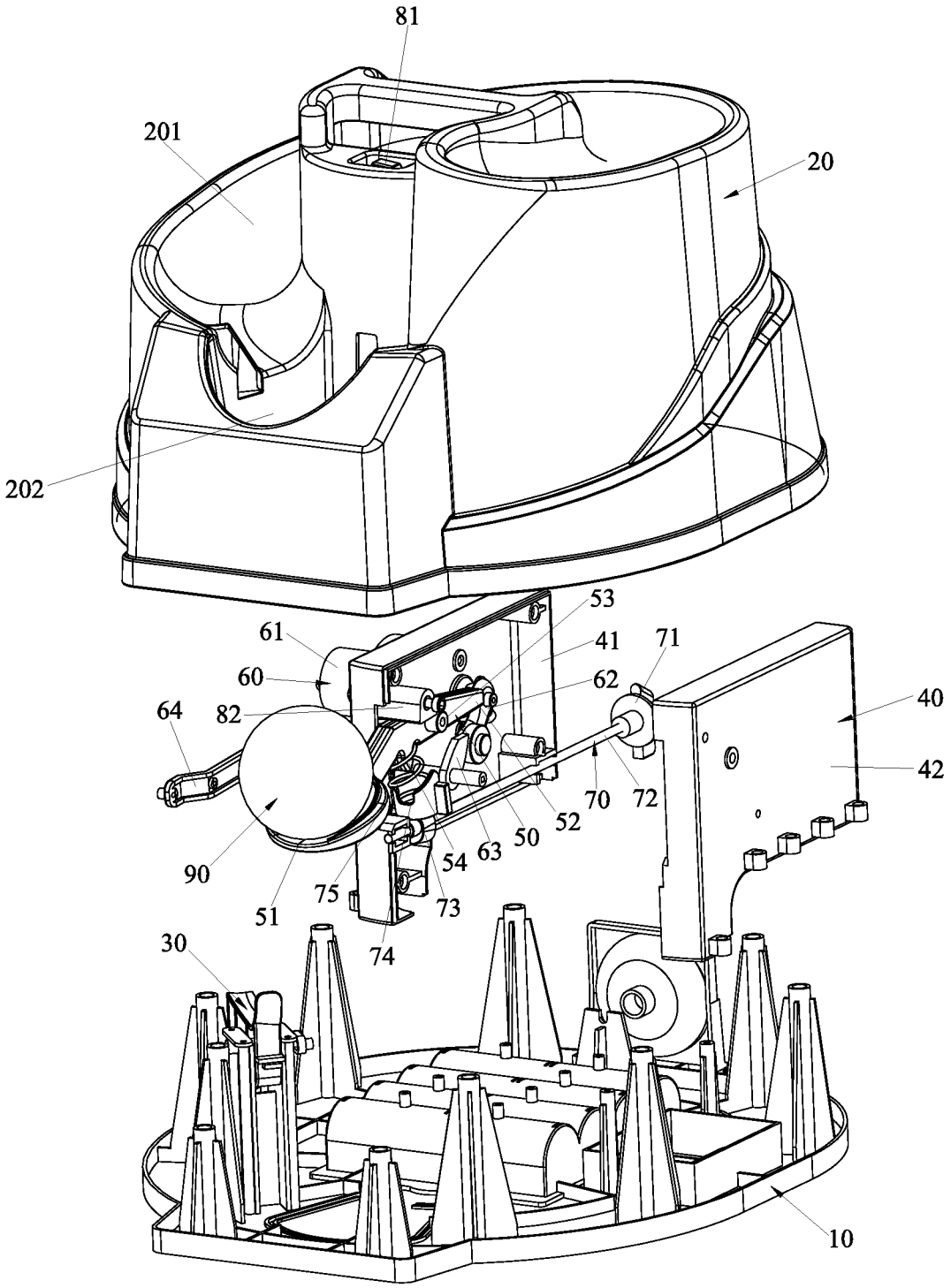
FIG. 2 is an exploded view in accordance with the preferred embodiment of the present invention.
Figure 3:
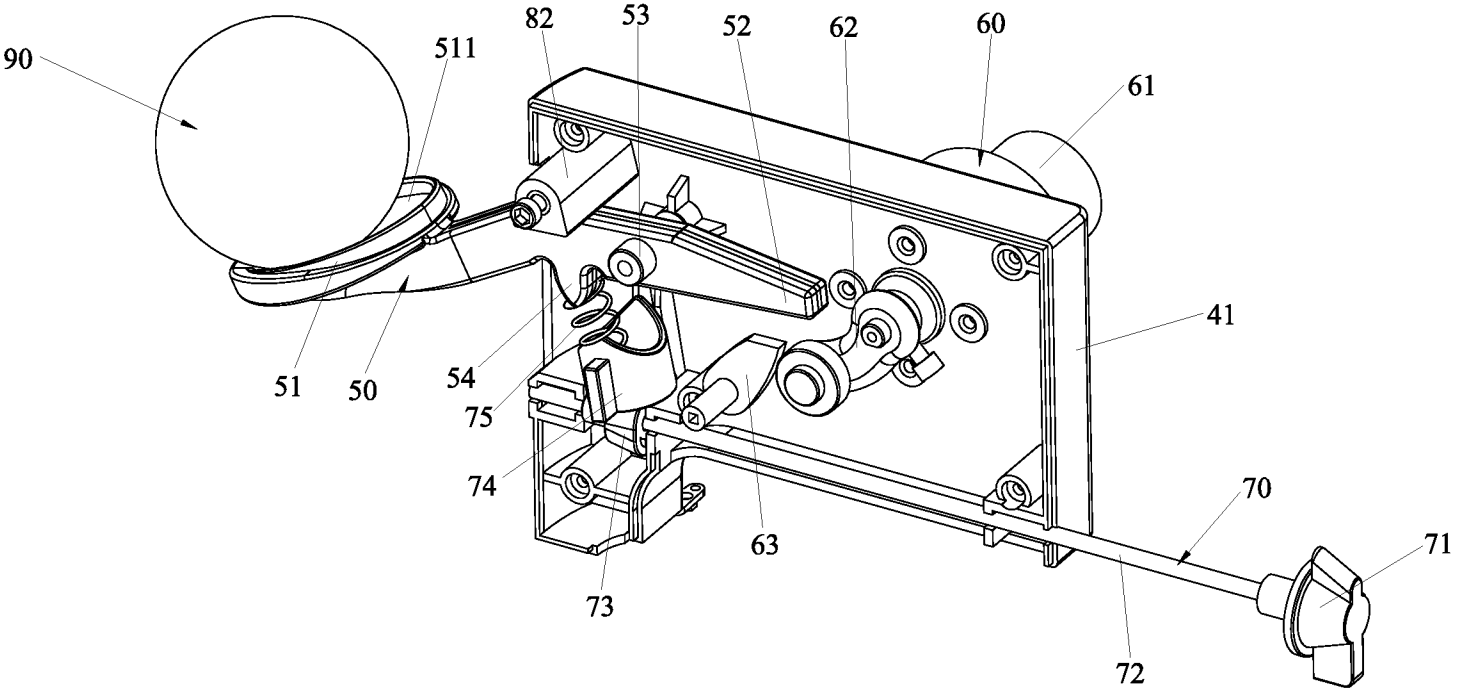
FIG. 3 is a partial assembled view in accordance with the preferred embodiment of the present invention.
Figure 4:
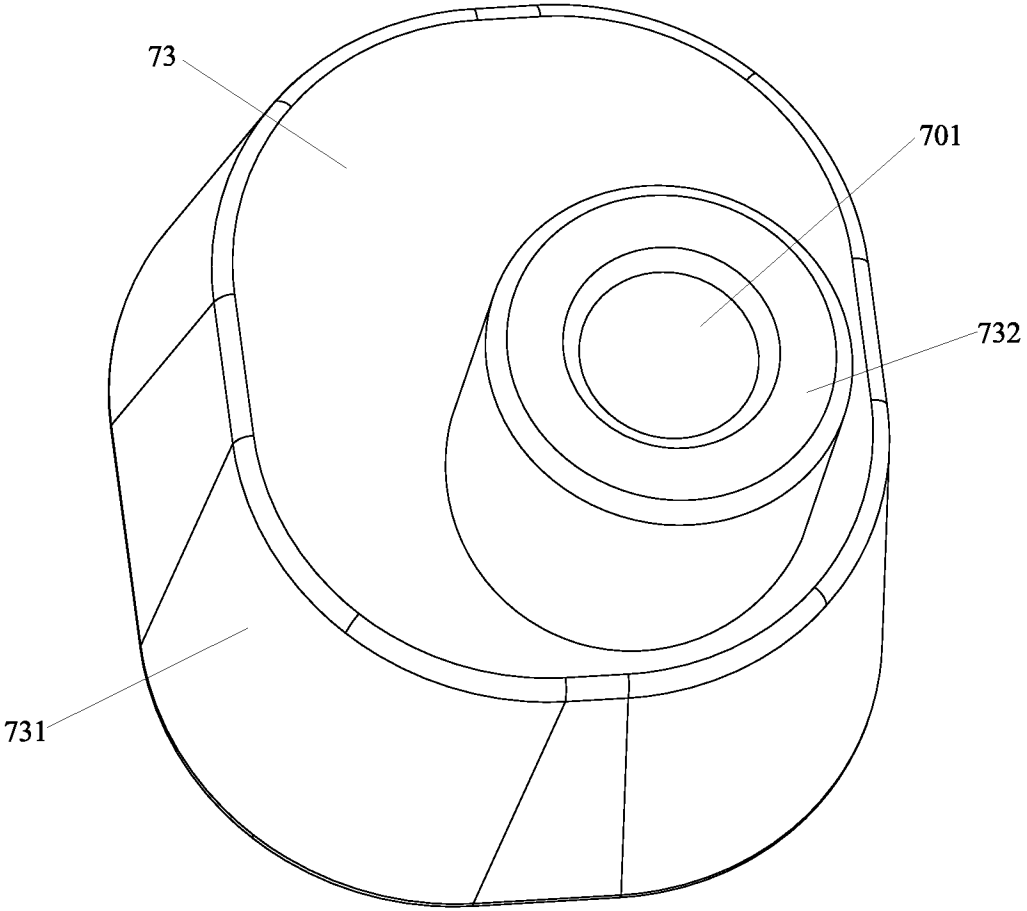
FIG. 4 is a perspective view of the adjusting wheel in accordance with the preferred embodiment of the present invention.

As shown in FIG. 1 to FIG. 4, a specific structure in accordance with a preferred embodiment of the present invention comprises a base 10, a housing 20, a ball-feeding wheel 30, an inner seat 40, a hitting rod 50, a driving device 60, and an adjusting device 70.

The bottom of the base 10 is recessed to form a battery receiving room, and the battery receiving room is covered with a battery cover. The housing 20 is fixed to the base 10. The outer surface of the housing 20 is formed with a ball passage 201. The housing 20 has a launching opening 202 passing through the inner and outer surfaces of the housing 20. The upper end of the launching opening 202 is in communication with the distal end of the ball passage 201. A baseball 90 is placed in the ball passage 201, and the baseball 90 is rolled into the launching opening 202 via the ball passage 201. The top of the housing 20 is provided with a switch 81 for controlling the operation of the baseball pitching apparatus.

The ball-feeding wheel 30 is pivotally connected to the base 10 and exposed at the distal end of the ball passage 201. A plurality of baseballs 90 are placed in the ball passage 201, and the ball-feeding wheel 30 blocks the baseballs 90. After one of the baseballs 90 is launched, the ball-feeding wheel 30 releases the next baseball 90 to fall into the launching opening 202. The rest may be deduced by analogy.

The inner seat 40 is fixed to the base 10 and located in the housing 20. The inner seat 40 includes a left seat 41 and a right seat 42. The left seat 41 and the right seat 42 are disposed symmetrically and coupled to each other. The hitting rod 50 is located between the left seat 41 and the right seat 42.

The hitting rod 50 is pivotally connected to and located in the inner seat 40. The front end of the hitting rod 50 has a hitting portion 51 located in the launching opening 202. The baseball 90 is dropped onto the hitting portion 51 via the launching opening 202. The hitting rod 50 includes a contact portion 52, a pivot portion 53, a protruding portion 54, and the hitting portion 51. The contact portion 52 is located at the rear end of the hitting rod 50. The driving device 60 is in contact with the contact portion 52. The pivot portion 53 is located between the contact portion 52 and the hitting portion 51. The pivot portion 53 is pivotally connected to the inner wall of the inner seat 40. The protruding portion 54 is located between the pivot portion 53 and the hitting portion 51. The protruding portion 54 extends downwardly from the bottom of the hitting rod 50. The hitting portion 51 is concavely formed with a recess 511 for receiving the baseball. The inner wall of the inner seat 40 is provided with a limiting board 82 for preventing an exceeding rotation of the hitting rod 50.

The driving device 60 is disposed on the inner seat 40. The driving device 60 drives the ball-feeding wheel 30 and the hitting rod 50 to turn. Specifically, the driving device 60 includes a motor 61, a rotating wheel 62, a transmission member 63, and a linking rod 64. The motor 61 is fixed to the inner seat 40. The rotating wheel 62 is connected to an output shaft of the motor 61 and rotates together with the output shaft of the motor 61. The contact portion 52 is located above the rotating wheel 62. When the rotating wheel 62 rotates, the contact portion 52 is driven to turn upward, and the hitting portion 51 is pressed downward to accumulate force. The transmission member 63 is pivotally connected to the inner wall of the inner seat 40 and located beside the rotating wheel 62. The rotating wheel 62 drives the transmission member 63 to rotate. One end of the linking rod 64 is connected to the transmission member 63 and located on the outer wall of the inner seat 40. Another end of the linking rod 64 is connected to the ball-feeding wheel 30. The linking rod 64 drives the ball-feeding wheel 30 to rotate, thereby feeding the baseballs 90 one by one to the hitting portion 51.

The adjusting device 70 is mounted to the housing 20 and located below the hitting rod 50. The adjusting device 70 is adjustable and elastically leans against the hitting rod 50. Specifically, the adjusting device 70 includes a knob 71, a rotating shaft 72, an adjusting wheel 73, a spring sleeve 74, and a spring 75. The knob 71 is disposed at one end of the rotating shaft 72 and exposed at the back of the housing 20. The rotating shaft 72 is disposed in the housing 20 and rotates together with the knob 71. The adjusting wheel 73 is disposed on the rotating shaft 72 and rotates together with the rotating shaft 72. In this embodiment, the adjusting wheel 73 includes a main body portion 731 and a raised portion 732. The peripheral surface of the main body portion 731 is in contact with the spring sleeve 74. The raised portion 732 extends outward from the top of the main body portion 731. The respective distances from the raised portion 732 to the four sides of the main body portion 731 are unequal, thereby forming four gear positions. The adjusting wheel 3 has a fixing hole 701 passing through the protruding portion 732 and the main body portion 731 for the rotating shaft 72 to pass therethrough. One end of the rotating shaft 72 passes through the adjusting wheel 73, so that the rotation knob 71 can be rotated to adjust the height of the spring sleeve 74 by the adjusting wheel 73. The spring sleeve 74 is movably disposed on the inner wall of the inner seat 40 to be moved up and down, and is located above the adjusting wheel 73. The adjusting wheel 73 drives the spring sleeve 74 to move up and down. The spring 75 is located between the spring sleeve 74 and the protruding portion 54. The lower end of the spring 75 leans against the inside of the spring sleeve 74. The upper end of the spring 75 leans against the protruding portion 54. When the contact portion 52 is turned upward, the protruding portion 54 is pressed downward to compress the spring 75, so that the spring 75 accumulates force to generate an elastic force for launching the ball upward.

The baseball pitching apparatus has four-gear elasticity adjustment. The housing 20 is designed to have a ball passage thereon, and nine baseballs can be used at a time. The baseball pitching apparatus has an automatic ball feeding function. The ball is launched every 5-6 seconds. The launching distance is between 0.8 meters and 1.6 meters, and the height is between 1.2 meters and 1.8 meters. The ball is launched stably, and the noise is low.

The working principle of this embodiment is described as follows:

When in use, the adjusting device 70 is first rotated to adjust the preload force of the hitting rod 50, a plurality of baseballs 90 are placed into the ball passage 201, the switch 81 is activated, and the driving device 60 starts to work. The rotating wheel 62 of the driving device 60 drives the ball-feeding wheel 30 to rotate, so that the first baseball 90 drops onto the hitting portion 51 in the launching opening 202. The rotating wheel 62 of the driving device 60 simultaneously drives the contact portion 52 of the hitting rod 50 to move up. The hitting portion 51 is moved downward, and the spring 75 of the adjusting device 70 is compressed downward to accumulate force for generating the elastic force. When the rotating wheel 62 is separated from the contact portion 52, the spring 75 is restored instantaneously, and the elastic force causes the hitting portion 51 to move up quickly for launching the baseball 90. According to this principle, the rest of the baseballs 90 are launched one by one.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multifunctional baseball pitching apparatus, comprising a base, a housing, a ball-feeding wheel, an inner seat, a hitting rod, a driving device, and an adjusting device; the housing being fixed to the base, an outer surface of the housing being concavely formed with a ball passage, the housing having a launching opening passing through inner and outer surfaces of the housing, an upper end of the launching opening being in communication with a distal end of the ball passage; the ball-feeding wheel being pivotally connected to the base and exposed at the distal end of the ball passage; the inner seat being fixed to the base and located in the housing; the hitting rod being pivotally connected to and located in the inner seat, a front end of the hitting rod having a hitting portion located in the launching opening; the driving device being disposed on the inner seat, the driving device driving the ball-feeding wheel and the hitting rod to turn; the adjusting device being mounted to the housing and located below the hitting rod, the adjusting device being adjustable and elastically leaning against the hitting rod.

2. The multifunctional baseball pitching apparatus as claimed in claim 1, wherein the inner seat includes a left seat and a right seat, the left seat and the right seat are disposed symmetrically and coupled to each other, and the hitting rod is located between the left seat and the right seat.

3. The multifunctional baseball pitching apparatus as claimed in claim 1, wherein the hitting rod includes a contact portion, a pivot portion, a protruding portion, and the hitting portion; the contact portion is located at a rear end of the hitting rod, the driving device is in contact with the contact portion; the pivot portion is located between the contact portion and the hitting portion, the pivot portion is pivotally connected to an inner wall of the inner seat; the protruding portion is located between the pivot portion and the hitting portion; the protruding portion extends downwardly from a bottom of the hitting rod; and the hitting portion is concavely formed with a recess for receiving a baseball.

4. The multifunctional baseball pitching apparatus as claimed in claim 3, wherein the inner wall of the inner seat is provided with a limiting board for preventing an exceeding rotation of the hitting rod.

5. The multifunctional baseball pitching apparatus as claimed in claim 3, wherein the driving device includes a motor, a rotating wheel, a transmission member, and a linking rod; the motor is fixed to the inner seat; the rotating wheel is connected to an output shaft of the motor and rotates together with the output shaft of the motor, the contact portion is located above the rotating wheel, the rotating wheel drives the contact portion to turn upward; the transmission member is pivotally connected to the inner wall of the inner seat and located beside the rotating wheel, the rotating wheel drives the transmission member to rotate; one end of the linking rod is connected to the transmission member and located on an outer wall of the inner seat, another end of the linking rod is connected to the ball-feeding wheel, and the linking rod drives the ball-feeding wheel to rotate.

6. The multifunctional baseball pitching apparatus as claimed in claim 3, wherein the adjusting device includes a knob, a rotating shaft, an adjusting wheel, a spring sleeve, and a spring; the knob is disposed at one end of the rotating shaft and exposed at a back of the housing; the rotating shaft is disposed in the housing and rotates together with the knob; the adjusting wheel is disposed on the rotating shaft and rotates together with the rotating shaft; the spring sleeve is movably disposed on the inner wall of the inner seat to be moved up and down and is located above the adjusting wheel, the adjusting wheel drives the spring sleeve to move up and down; the spring is located between the spring sleeve and the protruding portion, a lower end of the spring leans against an inside of the spring sleeve, and an upper end of the spring leans against the protruding portion.

7. The multifunctional baseball pitching apparatus as claimed in claim 6, wherein the adjusting wheel includes a main body portion and a raised portion, a peripheral surface of the main body portion is in contact with the spring sleeve; the raised portion extends outward from a top of the main body portion, respective distances from the raised portion to four sides of the main body portion are unequal, and the adjusting wheel has a fixing hole passing through the protruding portion and the main body portion for the rotating shaft to pass therethrough.

8. The multifunctional baseball pitching apparatus as claimed in claim 1, wherein a top of the housing is provided with a switch.

* * * * *